US005247268A

United States Patent [19]

Meise

[11] Patent Number: 5,247,268

[45] Date of Patent: Sep. 21, 1993

[54] ADJUSTABLE WAVEGUIDE BRANCH, AND DIRECTIONAL COUPLER

[75] Inventor: William H. Meise, Wrightstown, Pa.

[73] Assignee: General Electric Company, East Windsor, N.J.

[21] Appl. No.: 817,068

[22] Filed: Jan. 6, 1992

[51] Int. Cl.[5] ..... H01P 5/12

[52] U.S. Cl. ..... 333/111

[58] Field of Search ..... 333/111, 113, 114, 115-117, 333/109, 110, 248, 81 B, 24 R; 324/95; 343/756, 772

[56] References Cited

U.S. PATENT DOCUMENTS

| | | | |
|---|---|---|---|
| 4,635,006 | 1/1987 | Praba | 333/111 |
| 4,679,011 | 7/1987 | Praba et al. | 333/111 |
| 5,099,214 | 3/1992 | Rosen et al. | 333/157 |

OTHER PUBLICATIONS

"Laser Activated PIN Diode Switch from DC to mm--Wave", Rosen et al, published by IEEE in connection with Electro-89, Apr. 11-13, 1989.

*Primary Examiner*—Paul M. Dzierzynski
*Assistant Examiner*—Ali Neyzari
*Attorney, Agent, or Firm*—William H. Meise; Clement A. Berard; Stephen A. Young

[57] ABSTRACT

A rectangular waveguide series junction has a layer of photoconductive material in one branch near the junction. The photoconductive material, when dark, is essentially a dielectric, which effectively increases the dimension of the waveguide branch over what it would be if not modified, thereby increasing its impedance at the series junction and causing power division preferentially into the branch. When illuminated, as by a laser or LED, the photoconductive layer becomes a conductor instead of a dielectric, and the dieletric "increase" in the dimension is eliminated. Instead, the conductive material actually decreases the cross-section, to thereby reduce the actual impedance of the branch at the junction point. This reduces the amount of coupling below that for an unmodified waveguide branch. Thus, the amount of coupling into the branch at the junction is increased by the dielectric constant when the photoconductor is dark, and decreased by the conductivity when illuminated. A waveguide directional coupler includes one or more such controllable branches. Redundant light emitting diodes are located in slots adjacent the central seam of the directional coupler housing, for fine control of the coupling factor. Control may be applied to move nulls in the coupler isolation to reduce interference in antenna arrays, to adjust coupling to achieve improved channel-to-channel isolation, or to compensate for aging, or other changes of amplifiers or other circuit components.

9 Claims, 6 Drawing Sheets

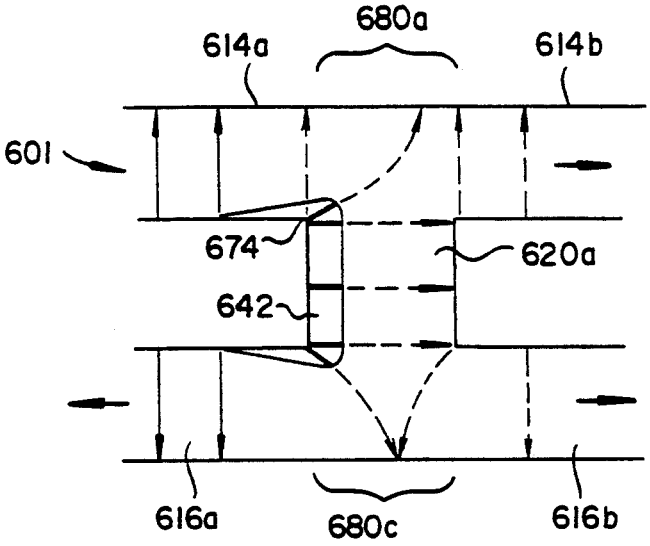
FIG. 8
FIG. 9
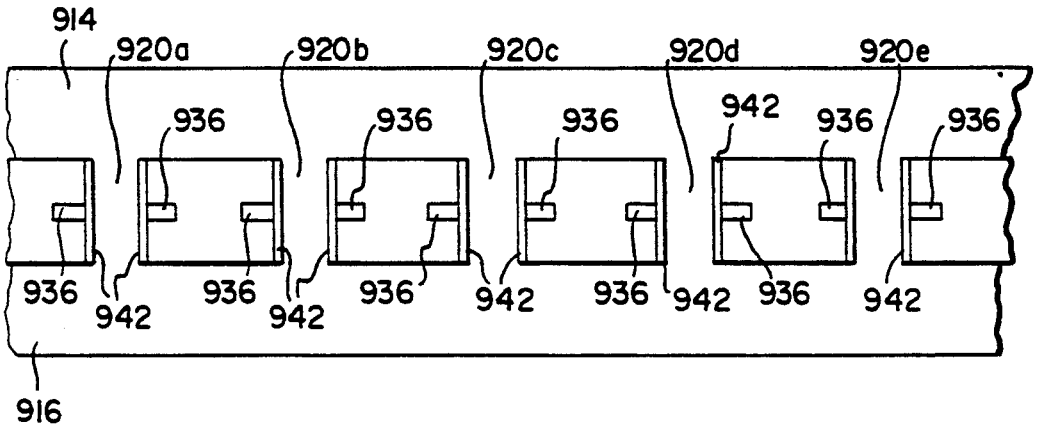
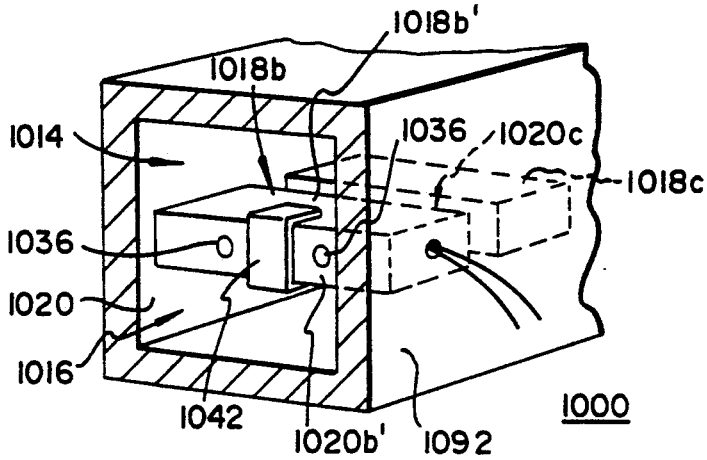
FIG. 10

ADJUSTABLE WAVEGUIDE BRANCH, AND DIRECTIONAL COUPLER

BACKGROUND OF THE INVENTION

This invention relates to adjustable waveguide branches, and to directional or hybrid couplers using such branches, and particularly to such branches and couplers using photoconductive materials to affect the division or coupling factor in response to light.

Hybrid or directional couplers are in widespread use for communications systems, providing power division and combining, and also providing differential phase shifts. U.S. Pat. No. 4,588,958, issued May 13, 1986 in the name of Katz et al, for example, describes a predistortion circuit which uses a 4-port, 3 dB, 90° directional coupler. Many other uses exist in the art. It should be noted that one of the four ports of such a hybrid coupler may be terminated in a resistive load, so it may have the appearance of a three-port coupler, even though it is fundamentally a four-port coupler. Such a coupler is described in U.S. Pat. No. 4,906,952 issued Mar. 6, 1991 to Praba et al.

Communications systems have been requiring progressively greater bandwidth in order to handle increasing information throughput. One way to increase the useful bandwidth of a system is to raise the operating frequency, as long as the percentage bandwidth is maintained. Thus, a system operating at a center frequency of 1 GHz with a 10% bandwidth has a useful bandwidth of 100 MHz, while if it could be operated at a center frequency of 10 GHz, the same 10% bandwidth would yield a 1 GHz information-carrying bandwidth. Thus, there is a continuing drive toward use of higher-frequency systems.

Satellite communications systems are by now well known, and use and reliance on such systems continues to grow. In response, the technology has been pushed to raise satellite communications systems from C band (about 5 GHz) towards X and K bands (8 to 12 and 10 to 15 GHz, respectively). Yet higher frequencies may be expected in the future. At these higher frequencies, transmission-line losses tend to be greater than at C-band and below. Also, it is more difficult to generate large amounts of power at high frequencies compared with low frequencies. Satellite communications systems often use hollow "waveguide" transmission lines for X and K-band when runs of significant length are required, even though it may be heavier and more difficult to fabricate and route than coaxial cable (coax). It should be noted that any transmission line may be termed a "waveguide", but hereinafter the term is used to describe hollow transmission lines having a conductive periphery. Waveguide is preferred to some other transmission lines because waveguide can achieve lower transmission loss. On the other hand, for very short runs where great losses are unlikely, as for example within integrated circuits which may be used for signal processing, strip transmission lines (stripline, microstrip) or their equivalent are often used.

In order to maximize the use of the available bandwidth in satellite communications systems, multiplexing schemes are used, by which, for example, polarization and frequency diversity are used in combination to aid in isolating communication channels from each other. The multiplexing schemes make use of hybrid or directional couplers, as described for example in U.S. Pat. No. 5,025,485, issued Jun. 18, 1991 in the name of Csongor et al.

At high frequencies, wavelengths are small, and standard manufacturing tolerances tend to become larger in terms of wavelength than would be the case at lower frequencies. This in turn means that it is more difficult to accurately fabricate a coupler to a specific coupling factor at higher frequencies, and it also means that, in the context of coupler ports which are intended to be mutually isolated, a given level of isolation may be difficult to achieve. U.S. Pat. No. 4,679,011, issued Jul. 7, 1987 in the name of Praba et al, describes a manufacturing technique by which replaceable blocks are used as an aid to achieving the desired coupling factors. This scheme allows the coupling to be set during manufacture by assembling the system with a set of blocks, and by disassembling and changing the blocks if the coupling is incorrect. Another scheme is described in U.S. Pat. No. 4,635,006, issued Jan. 6, 1987 in the name of Praba, in which the walls of a through waveguide of a directional coupler are distorted by pressure in order to affect the coupling factor. This allows the coupler to be adjusted to some degree after manufacture.

However, neither of these schemes allows the coupling to be changed in a simple manner when the coupler is at a remote location, such as a spacecraft in orbit. Such a change of coupling may be desirable to ameliorate the effects of frequency shifts due to damage or age, interference at particular frequencies which might make it desirable to optimize port-to-port isolation at a particular frequency, and other imponderables. Such a change of coupling could also be used to trim an antenna beam-forming network to redirect an antenna beam.

SUMMARY OF THE INVENTION

First, second and third transmission lines are joined to form a transmission-line branch. Electromagnetic signal applied to the first transmission line of the branch divides to flow to the second and third transmission lines in accordance with their relative impedances. The impedance of at least the second transmission line is rendered controllable to allow variation of the signal power coupling between the second and third transmission lines. The impedance variation is provided by photosensitive material placed within the field of at least the second transmission line at a location near the junction. The photosensitive material is relatively nonconductive and has a relative dielectric constant greater than unity in one illumination mode, and is electrically conductive in another illumination mode. In one embodiment of the invention, the transmission lines are rectangular waveguides joined at an E-plane junction. The photosensitive material is a layer of semiconductor supported on at least a portion of a broad wall of the second waveguide, near the junction. The semiconductor material may be about intrinsic silicon, germanium or gallium-arsenide, in which case it is electrically conductive when illuminated; when not illuminated it is a nonconductive dielectric material.

DESCRIPTION OF THE DRAWINGS

(FIGS. 1*a* and 1*b* are together referred to as FIG. 1);

FIG. 8 illustrates details of a waveguide branch junction in accordance with the invention;

FIG. 9 is a plan view of a five-branch waveguide directional coupler illustrating multiple uses of an adjustable waveguide branch according to the invention within one coupler;

FIG. 10 is a perspective or isometric view of a section of a branch waveguide directional coupler in accordance with another embodiment of the invention;

DESCRIPTION OF THE INVENTION

FIG. 1 illustrates a portion of the interior of a waveguide branch directional coupler 10. The illustrated portion includes two mating halves 12*a* and 12*b*, such as are described, for example, in U.S. Pat. No. 4,679,011, issued Jul. 7, 1987 in the names of Praba et al. In general, an illustrated half-portion includes a housing block 12*a* of conductive material such as aluminum, milled or formed to define first and second rectangular channels 14 and 16 which extend through the active portion of directional coupler 10. Generally, channels 14 and 16 are mutually parallel.

Figures 1A, 1B:
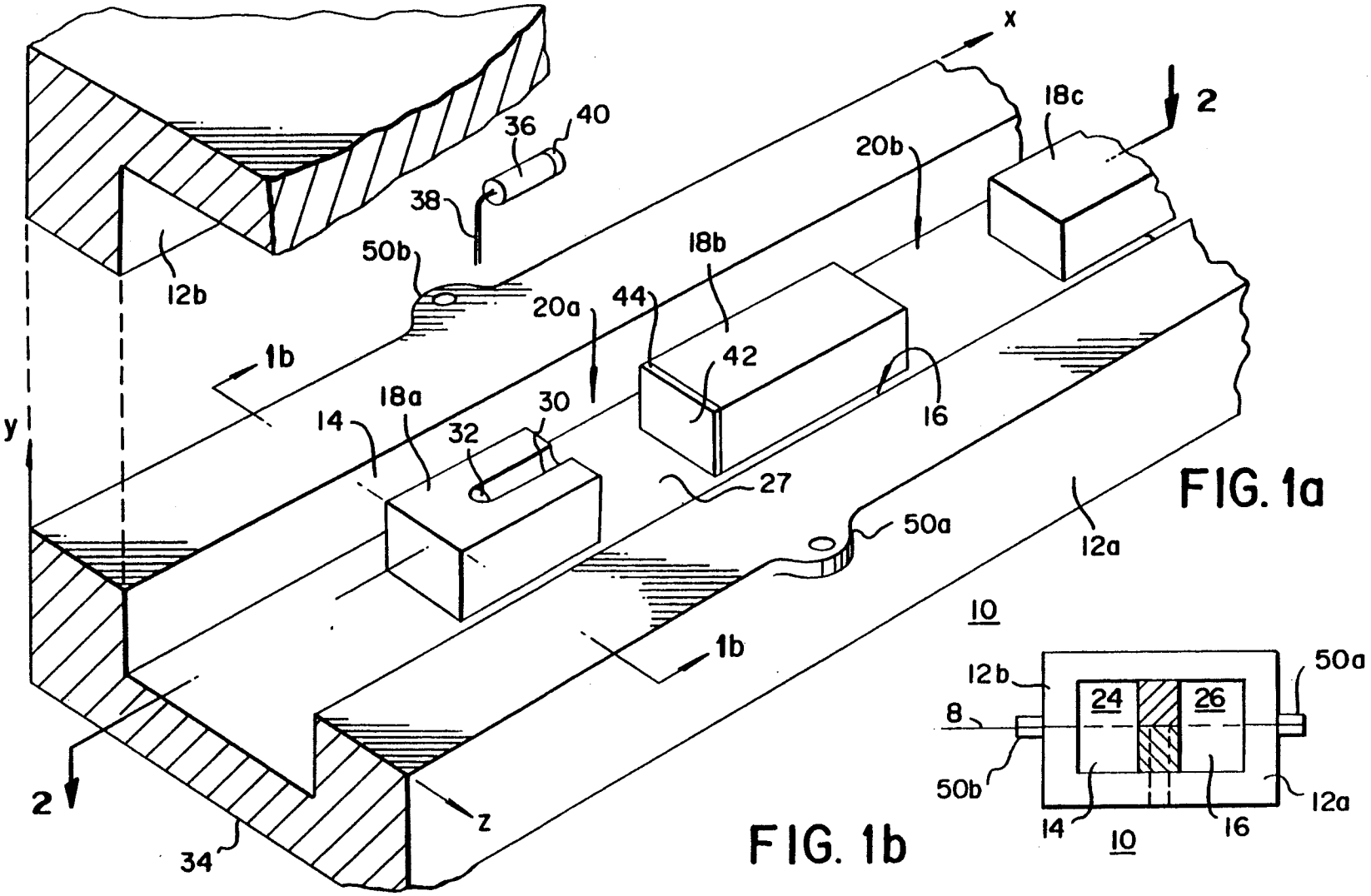
FIG. 1*a* is an exploded perspective or isometric view of an interior portion of a waveguide-type branch directional coupler including a controllable branch in accordance with the invention.
FIG. 1*b* is a sectional view of the arrangement of FIG. 1 in its assembled form

Block 12*a* is also milled or otherwise formed to include a plurality of blocks 18*a*, 18*b*, 18*c* . . . , which are spaced apart to define further channels 20*a*, 20*b*, . . . therebetween, which extend between channels 14 and 16. When block 12*a* is mated with a second matching or mating block 12*b*, and fastened thereto by screws (not illustrated) through bosses 50*a*, 50*b*, channels 14, 16 and 20*a*, 20*b* . . . define or form rectangular electromagnetic waveguides. In FIG. 1*b*, the two through waveguides formed, in part, by channels 14 and 16 are designated 24 and 26, respectively. Similarly, although not specifically illustrated, branch channels 20*a*, 20*b* . . . when mated with corresponding channels in block 12*b*, from rectangular branch waveguides intersecting with through waveguides 24 and 26. The junction or intersection of the rectangular branch waveguides of which channel 20*a* is a part with through waveguide 26, of which channel 16 is a part, occurs around a point illustrated by an asterisk 27. A structure such as 10 of FIG. 1 is well known for, when properly dimensioned, forming a directional coupler of the rectangular waveguide type.

As also illustrated in FIG. 1*a* and in accordance with an aspect of the invention, a groove 30 having a semicircular cross-section is formed along the upper edge of block 18*a*. At the interior end of groove 30, a hole or aperture 32 is formed, which extends through block 18*a* to lower surface 34 (not visible in FIG. 1*a*) of block 12*a*. A cylindrical light source 36 fits into groove 30, and is dimensioned (or shimmed) for a snug fit. A pair of electrically conductive wires 38, properly insulated, extend from the rear face of source 36, and through hole 32 to the exterior of the coupler, for providing electrical energy to source 36 from an external source (not illustrated). Source 36 also includes a light-transparent, electrically conductive end cap 40 on its front or light-emitting end. Such a material may be a thin layer of indium-tin oxide.

Block 18*b* includes a planar surface 42, which is a portion of the broad wall of the branch waveguide of which channel 20*a* is one-half. For simplicity, the channel in block 12*a* and the waveguide formed by the two mating halves are designated by the same reference numeral. Thus, channel 20*a* of block 12*a*, together with its mating half in block 12*b*, defines a branch waveguide which is also designated 20*a*. Surface 42 of block 18*b* is part of a broad wall of branch waveguide 20*a*. As illustrated in FIG. 1*a*, a layer 44 of photosensitive or photoconductive material is placed over face 42 of block 18*b*. Semiconductor materials such as silicon (Si), germanium (Ge) or gallium arsenide (GaAs) are preferred, but other materials such as selenium may be used. The semiconductor materials may be intrinsic or near intrinsic (lightly doped).

In operation, signals near a design frequency may be applied to a port (which, in the case of a waveguide transmission line, is simply an open end) of through waveguide 24, and the signals so applied divide among the various branch waveguides and propagate to through waveguide 26 with various amplitudes and phases. Those skilled in the art know how to dimension the branch and through waveguides to achieve the desired performance. The desired performance is often a particular amount or amplitude of coupling to two output ports of waveguides 24 and 26, and zero coupling to the remaining fourth port of waveguide 26. A well-known type of coupler is a 3 dB, 90° coupler, which divides signal applied to the input port of waveguide 24 into two equal amplitude portions (−3.01 dB) at the two output ports, and with the output of one output port phase advanced by nominally 90° relative to the other.

Figure 2:
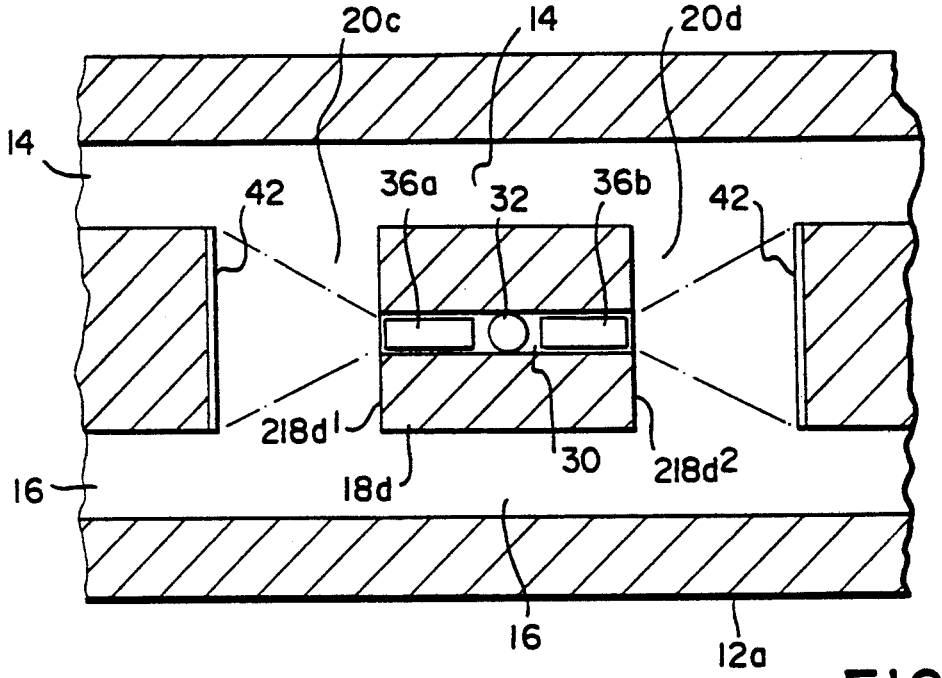
FIG. 2 is a sectional plan view of an arrangement similar to that of FIG. 1, but including a plurality of controllable branches, each with one light source.

FIG. 2 illustrates an interior cross-sectional view of a structure similar to that of FIG. 1, but including plural light sources for illuminating each of two branch waveguides. The cross-section of FIG. 2 is taken at a distance from parting plane 8 of FIG. 3. Elements of FIG. 2 corresponding to those of FIG. 1 are designated by the same reference numerals. In FIG. 2, block 18*d* has faces $218d^1$ and $218d^2$ adjacent to branch waveguides 20*c* and 20*d*, respectively, and includes a groove 30 extending all the way through block 18*d* from faces $218d^1$ to 218$d^2$, with a hole 32 in the center of the groove, extending to the exterior of the coupler, for the source energizing wires. A pair of light sources 36*a* and 36*b* are located in the grooves, with their light-emitting faces, and the electrically conductive surface thereon, flush with faces 218$d^1$ and 218$d^2$ of the block, which as mentioned are the faces of the branch waveguides 20*c*, 20*d*. Since the cross-section of the structure illustrated in FIG. 2 is taken at a distance S form parting plane 8, the combination of block 12*a* of FIG. 2 together with another matching block 12*b* results in a structure similar to that illustrated in perspective or isometric view in FIG. 3, in which plural light sources are associated with each branch waveguide.

Figure 3:
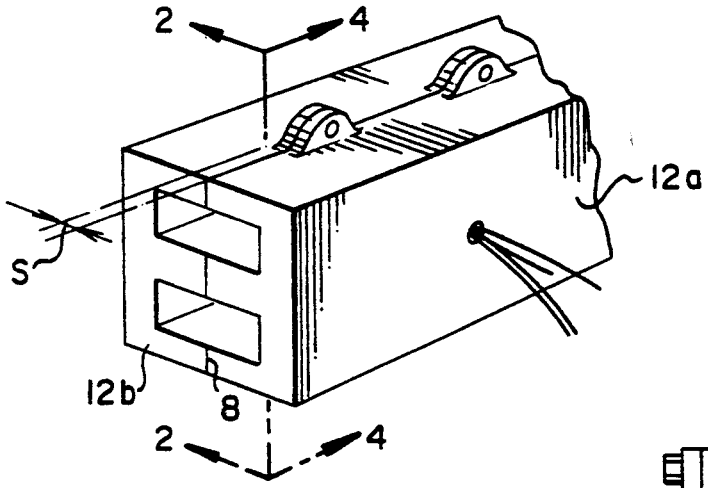
FIG. 3 is a perspective or isometric view of the exterior of the coupler of FIG. 2 mated to its matching half.
Figure 4:
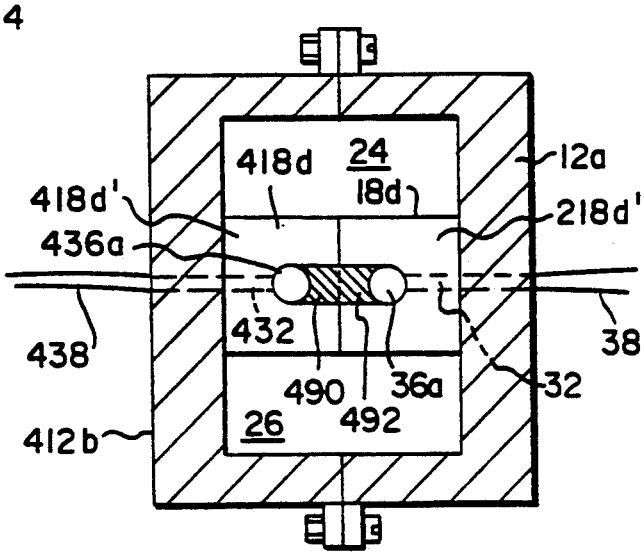
FIG. 4 is an end view of a section of the branch directional coupler of FIGS. 2 and 3 in accordance with the invention, illustrating the locations of pairs of light sources associated with each branch waveguide.

Elements of FIG. 4 corresponding generally to those of FIGS. 2 and 3 are designated by the same reference numerals, and those of the matching half-portion are designated by like reference numerals in the 400 series. In FIG. 4, two light sources 36 and 436 face (toward the viewer) into the branch waveguide adjacent face 218*d* of block 18*d*. The use of multiple sources in this manner helps to avoid the use of lenses to shape the beams to illuminate the full surface of the adjacent block, or if full area coverage is not needed, provides redundancy for high reliability. Filler block 492 fills in that portion of groove 30 in block 18*d* not occupied by light source 36*a*, and filler block 490 serves a like function for mating block 418*d*.

Figure 5A:
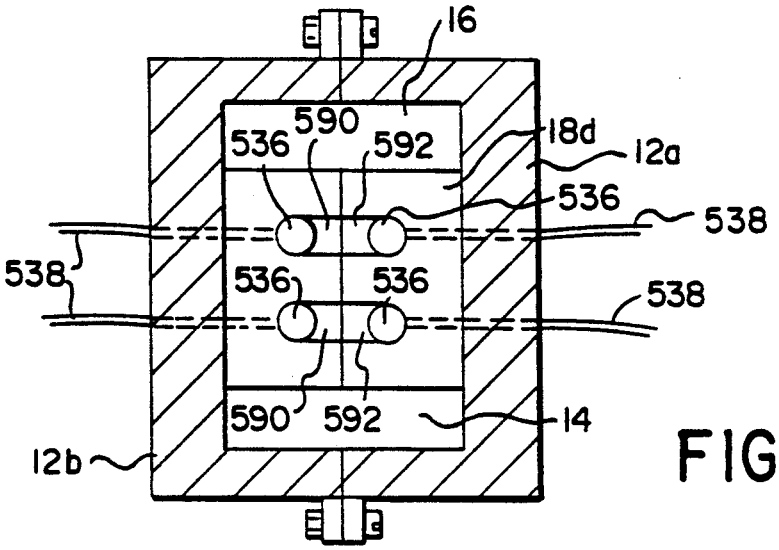
FIG. 5*a* is an end view of a section of a branch directional coupler in accordance with another embodiment of the invention, illustrating plural light sources associated with each branch waveguide.
Figure 5B:
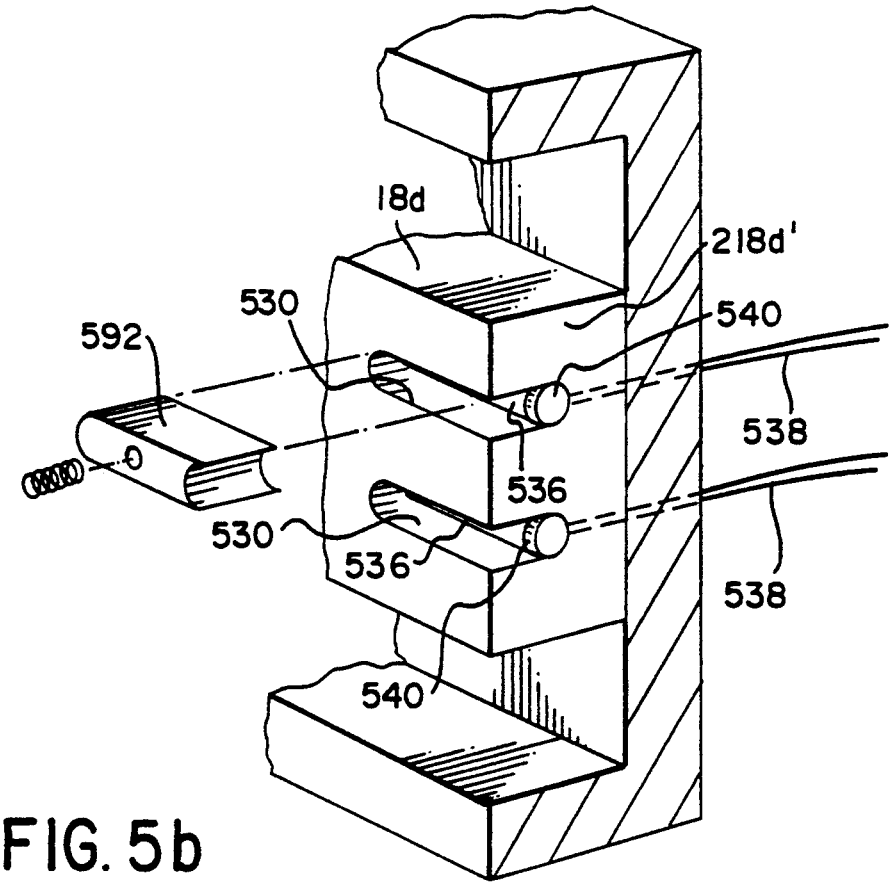
FIG. 5*b* is a partially exploded perspective or isometric view of one-half of the structure of FIG. 5*a* (FIGS. 5*a* and 5*b* are together referred to as FIG. 5)

FIG. 5*a* is an end section similar to FIG. 4, illustrating an embodiment with four lamps 536 for illuminating the branch waveguide, energizing wires 538 for each light source, and a pair of filler blocks 590 and 592. FIG. 5*b* is a partially exploded view of a portion of the structure of FIG. 5*a*, illustrating the shape of the filler block for filling in that portion of grooves 530 not occupied by a light source 536. As illustrated, block 592 bears against the edge of indium-tin oxide coating 540 on the light-emitting end of light source 536 to form a continuous conductive surface 218$d^1$ of block 18*d*.

Figure 6:
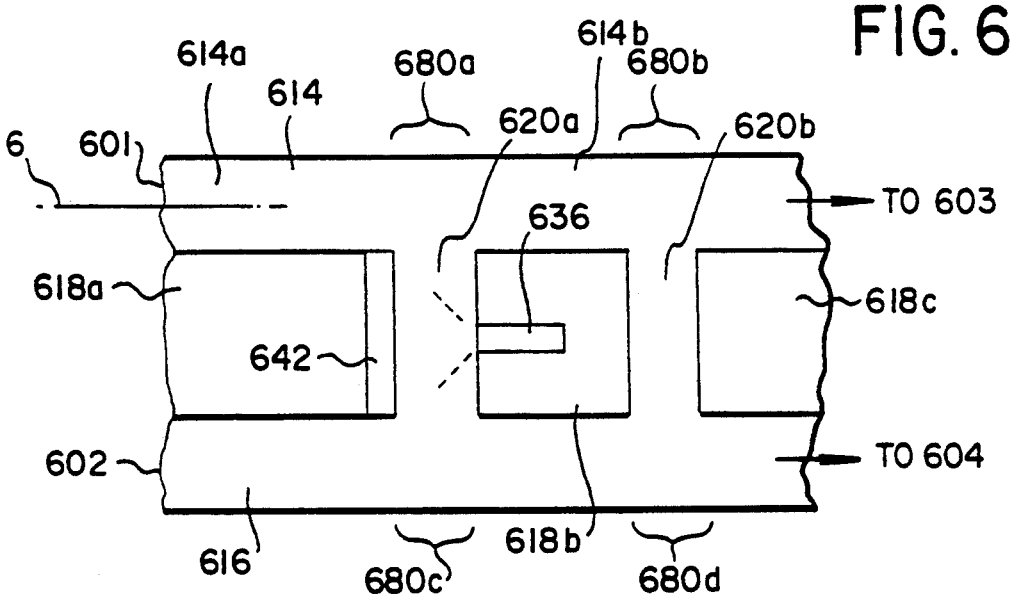
FIG. 6 is a conceptual plan view of a waveguide transmission-line E-plane branch directional coupler.

FIG. 6 is a simplified or conceptual view of a portion of a directional or hybrid coupler. In FIG. 6, a through waveguide 614 extends from an input port 601, past block 618*a*, junction region 680*a* with branch waveguide 620*a*, block 618*b*, junction region 680*b* with branch waveguide 620*b*, and block 618*c*, to an output port (not illustrated). The direction of elongation of through waveguide 614 is parallel to an axis 6. Similarly, through waveguide 616 progresses from an input port 602 past blocks 618*a*, 618*b* and 618*c*, and past junctions 680*c* (branch 620*a*) and 680*d*(branch 620*b*), toward a second output port (not illustrated), also parallel to axis 6. A light source 636 controllably illuminates a photoconductive coating 642 on block 618*a*.

Figure 7A:
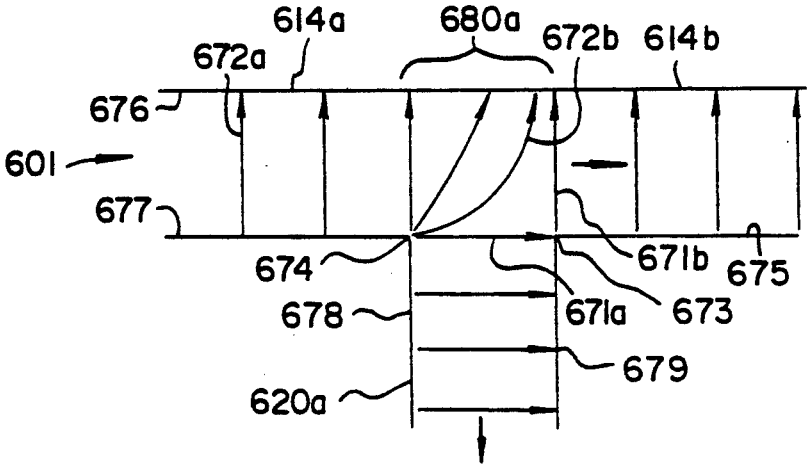
FIG. 7a PRIOR ART
FIG. 7*a* illustrates traverse electric fields which may occur in an E-plane branch waveguide junction according to the prior art.

FIG. 7*a* is a conceptual illustration of the electric field configuration near an E-plane waveguide junction in a prior art junction (i.e. without the photoconductive surface 642 and controllable illumination 636) corresponding to a portion of FIG. 6. In FIG. 7*a*, electric field lines are illustrated by arrows. Those skilled in the art realize that the electric field amplitudes change and periodically reverse as signals propagate through the structure, but the simplified concept using arrows is useful in understanding what happens at the junction. The electric field lines 672*a* near input port 601 are transverse to the direction of elongation 6 of through waveguides 614, with the tip or head of the arrow terminating orthogonally on broad wall 676 and the tail terminating orthogonally on board wall 677. The field remains transverse until the junction is reached. At the junction, the field lines "stretch" from the corner 674 of broad walls 677 and 678, bending to "belly" toward the corner 673 of walls 675 and 679, as illustrated by arrow 672*b*. Eventually, the belly becomes pronounced enough to cause the center of the field line to "attach" to corner 673, at which condition the field line is broken into two portions, one portion 671*a* having its tail at corner 674 and its head at corner 673, and the other portion 671*b* with its tail at corner 673 and its head on broad wall 676. The power division between branch waveguide 620*a* and the output side 614*b* of the through waveguide depends upon the relative impedances of the two output waveguides at the junction, which may be though of as being related to the relative lengths of the two field line arrows 671*a* and 671*b*. For example, if branch waveguide 620*a* is small in cross-section relative to waveguide 614*b*, the field line extending across its "mouth" at the junction will be shorter than the field line at the "mouth" of waveguide portion 614*b*, and the signal amplitude propagated into branch waveguide 620*a* is therefore smaller than that propagated into waveguide portion 614*b*. Naturally, equal-dimension waveguides result in equal-amplitude outputs.

Figure 7B:
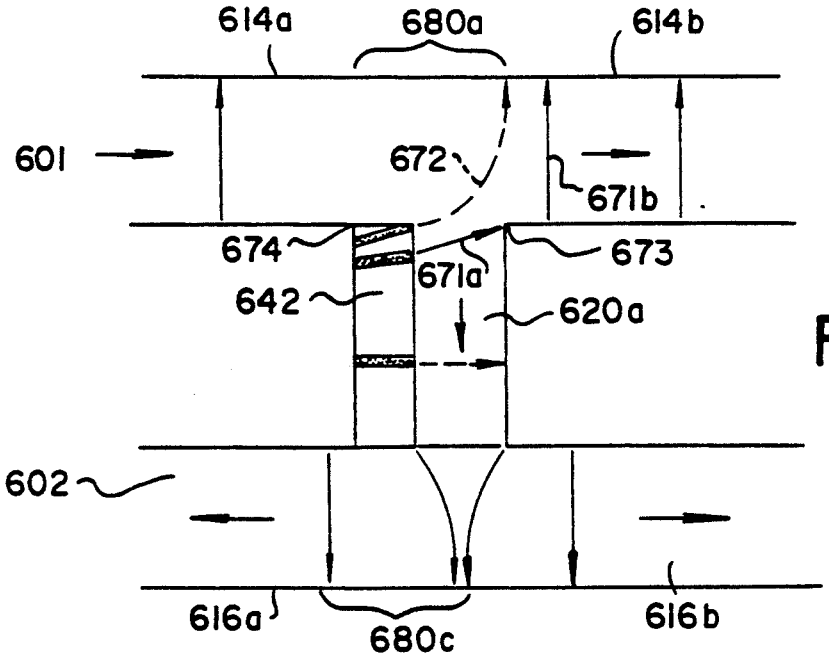
FIG. 7*b* illustrates transverse electric fields which may occur in E-plane branch waveguide junctions in accordance with the invention.

FIG. 7*b* illustrates the effect when a broad wall of a branch waveguide has a coating of a material with a relative dielectric constant greater than unity. This corresponds to the condition in which a photoconductor is not illuminated. As illustrated, arrow 671 has a portion of its tail within coating 642. The portion of the tail within coating 642 is illustrated by a heavy solid line, denoting the relatively large portion of the electric field energy concentrated with the dielectric material. The concentration of the field in the dielectric material causes the remainder of field line 672 to be attenuated or weakened, represented in FIG. 7*b* by a dashed portion of arrow 672. When the belly of arrow 672 is sufficiently large to contact corner 673, that portion of the field represented by arrow 671*a* (including the portion of 671*a*in the dielectric) has greater amplitude than the portion represented by arrow 671*b*. Thus, the presence of the dielectric coating causes a preferential signal amplitude or power division in favor of the branch with the dielectric coating. Thus, in FIG. 7*b*, branch waveguide 620*a* is "preferred" over the other branch, which is the continuation 614*b* of the through waveguide 614. The coating can be tapered toward zero thickness in the preferred waveguide at regions remote from the junction, or, as illustrated in FIG. 7*b*, continued to the next junction, which is junction 680*c* of branch waveguide 620*a* with through waveguide portions 616*a* and 616*b*. At junction 680*c*, the signal preferentially divides toward or in favor of waveguide portion 616*a*, which has a broad wall adjacent dielectric layer 642, rather than toward waveguide portion 616*b*, which does not have a broad wall adjacent dielectric layer 642. For the situation illustrated in FIG. 7*b*, for equal-size waveguides, the signal from port 601 preferentially couples through branch waveguide 620 rather than through waveguide portion 614*b*, and of that signal portion flowing in branch waveguide 620*a*, the division between guide portions 616*a* and 616*b* prefers 616*a*. The presence of a dielectric layer or a broad wall makes the narrow wall effectively larger, thereby effectively increasing its impedance in an E-plane tee junction. The increased effective impedance causes diversion of more power into the branch, at the expense of reduced power into the other branch.

When photoconductive coating 42, 642 is illuminated by a source of light such as 36 or 636, it becomes electrically conductive. In effect, the adjacent broad walls of the branch waveguide move closer together, actually decreasing the narrow dimension, thereby decreasing the effective impedance and reducing the power coupled into the branch waveguide, while increasing that portion of the incident power which is coupled to the through waveguide. Thus, the described structure allows the amplitude signal amplitude or power division at a branch junction to be varied in response to illumination. The change from a dark condition to an illuminated condition has two effects: (a) it "removes" the dielectric material (by converting it to a conductor), thereby removing the effective increase in waveguide dimension attributable to the dielectric constant; and (b) it narrows the actual spacing between adjacent broad conducting walls. Both of these effects work in the same direction, namely to decrease the effective waveguide impedance at a series waveguide junction when dark, and to decrease the impedance when illuminated.

FIG. 8 is similar to FIG. 7*b*, but differs in that the photoconductive material 642 "wraps" around the corner between branch waveguide 620*a* into through waveguide portion 614*a*, in order to provide a more gradual transition, and to guarantee that the electric field couples into the dielectric at corner 674. Also, the photoconductive material tapers to zero thickness in main guides 614*a* and 616*a*.

FIG. 9 illustrates a conventional view of a coupler with parallel through waveguides 914, 916 and five branches 920*a*, 920*b*, 920*c*, 920*d* and 920*e*, in which each branch waveguide has both broad walls fitted with a layer of photosensitive material 942, and in which each broad wall is fitted with an illumination source 936 for illuminating the opposite wall. Each illumination source 936 protrudes slightly past the photoconductive material on its own side wall, or, if the illumination source is flush with the surface of the wall, an aperture in the photoconductor on the wall prevents attenuation of the light intended for the opposite wall.

FIG. 10 is a perspective or isometric view, partially cut away, of a directional coupler 1000. In FIG. 10, coupler 1000 includes conductive blocks 1018*b* and 1018*c*. Block 1018*b* has a face 1020*b*[1] which is one broad wall of the branch waveguide (not designated) through which the section cut is made. Through waveguides 1014 and 1016 go past blocks 1018*b* and 1018*c*. Another branch waveguide 1020*c* lies between blocks 1018*b* and 1018*c*, and extends from through waveguide 1014 to through waveguide 1016. In FIG. 10, a layer 1042 of photoconductor is affixed to face 1020*b* of block 1018*b* only near the center of the block, halfway between walls 1090 and 1092, which is also halfway between the narrow walls of waveguides 1014 and 1016. This is a location at which the electric field strength is greatest in the TE mode, so almost the same control effect can be created without covering an entire surface of the waveguide with photoconductor in the vicinity of the junction. As illustrated in FIG. 10, photoconductor layer 1042 extends around onto the through-waveguide-facing wall 1018*b*[1] of block 1018*b*, to aid in coupling. A pair of light sources 1036, adjoining photoconductor 1042, illuminate the photoconductor on the facing wall (not illustrated). Photoconductor 1042 is illuminated by a pair of sources (not illustrated) corresponding to 1036, on the facing wall (not illustrated).

As an alternative, light sources 1036 could be located under photoconductor 1042 to illuminate it from the underside, with the same effect. Also, the light source could be a planar or distributed light source as known in the art, affixed to a broad wall.

In a directional coupler, small changes in the smaller dimension (i.e. between broad walls) of the various branch waveguides can result in significant changes in performance. In particular, such changes can be tabulated, and the amount of illumination required at each branch for a particular coupling factor can be stored in memory, as for example in a ROM. When a particular coupling factor is desired, the stored information in memory is accessed, and the resulting illumination or light source excitation current is read. One or more digital-to-analog converters then convert the information to analog form to drive the light source or sources.

Figure 11:
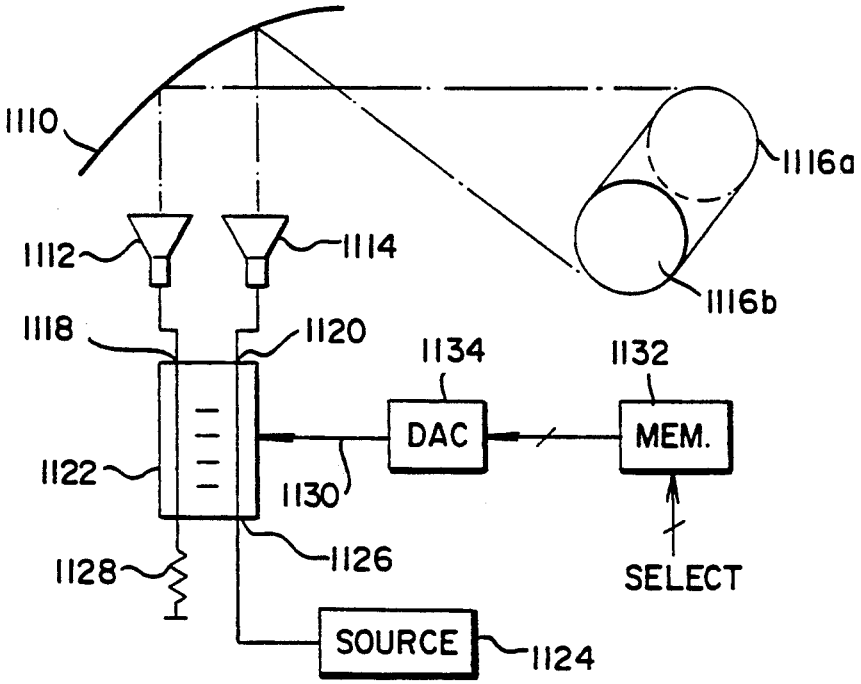
FIG. 11 illustrates an antenna system using a coupler according to the invention to change the effective beam direction.

FIG. 11 is a simplified diagram illustrating an antenna system which might find use for antenna beam direction control in a satellite. In FIG. 11, a reflector illustrated as 1110 has plural feed antennas illustrated as horns 1112, 1114, which when energized illuminate the reflector with RF to radiate over portions 1116*a*, 1116*b* of a continental area, with feed antenna 1112 providing the principal illumination of portion 1116*a*, and feed antenna 1114 principally illuminating portion 1116*b*. Feed antennas 1112, 1114 receive approximately equal power from the output ports 1118, 1120, respectively, of a controllable hybrid coupler 1122 according to the invention. A signal source 1124 drives an input port 1126 of coupler 1122. Any reflected energy is routed to a load illustrated by a resistor symbol 1128, coupled to the fourth port.

One or more light source powering wires 1130 couple to one or more light sources within coupler 1122, which control branch power division as described above. An addressable memory ROM 1132 is pre-loaded with digital representations of the light source voltages required to provide a particular coupling factor of the directional coupler. A digital-to-analog converter (DAC) 1134 converts the light-representative voltage signal into a corresponding voltage for application to the light source(s). A particular coupling factor is selected by addressing the memory with the address signals corresponding to the desired coupling factor. The memory produces digital signals which represent the voltage (or current) to be applied to each light in coupler 1122 to achieve the desired coupling, and DAC 1134 converts the digital signals into analog drive signals. The drive signals illuminate the light sources by the amount required to achieve the selected coupling factor. By causing more energy to be routed to antenna 1112 and less to antenna 1114, the effective portion of the radiation region 1116 moves generally up and to the right, as region 116*a* "grows" and region 1116*b* "shrinks". As the beams move, the nulls associated therewith also move, and can be placed, if desired, to reduce interference. Of course, this concept may be expanded to control plural couplers and larger numbers of radiating elements. Direct radiating arrays of elements may be controlled, rather than reflector feed antennas.

In a satellite communication system using waveguide branch couplers, it may be advantageous for interplanetary missions to store a plurality of different excitation factors for each coupler in on-board ROM, so that only the desired coupling factor needs to be up-linked to address the ROM. This reduces the command information which must be transmitted over low data rate systems as are common in long-distance communicators. On the other hand, for geosynchronous satellites, an up-link can load the desired current (today's) information about the electron current flow required for the desired coupling factors into a RAM, thus storing only information relative to one coupling factor, namely the one now in use, and which maintains the current flow values until the next set of data is up-linked. This is advantageous because the current (the present) values can be updated as the light sources age or unexpected conditions arise, to maintain the desired coupling factor regardless of the aging or other influence.

Figure 12:
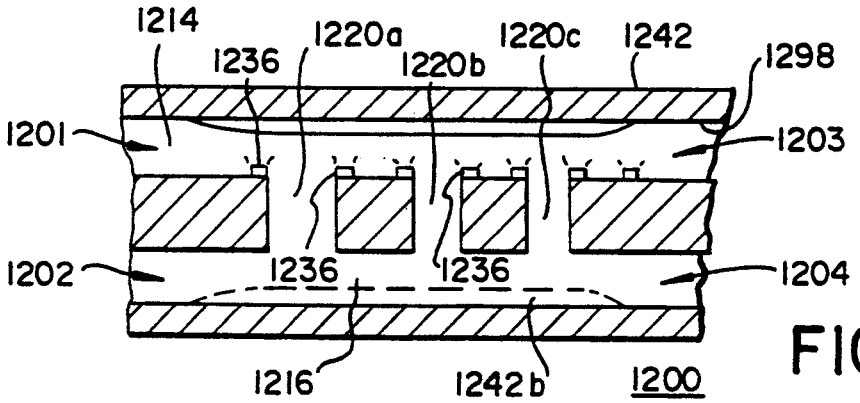
FIG. 12 is a cross-section of a 3-branch coupler according to the invention, illustrating another location for the photoconductive material.

FIG. 12 illustrates another embodiment of the invention. In FIG. 12, elements corresponding to those of FIG. 1 are designated by like reference numerals, in the 1200 series. In FIG. 12, a 3-branch directional coupler 1210 includes a first through waveguide 1214 extending from a port 1201 to a port 1203, and a second through waveguide 1216, parallel to waveguide 1214, extending from port 1202 to port 1204. Three branch waveguides 1220*a*, 1220*b* and 1220*c* extend between through waveguides 1214 and 1216. A layer 1242 of photoconductive material is affixed to a broad wall 1298 of through waveguide 1214, which is illuminated by a plurality of light sources, some of which are designated 1236. While illustrated as protruding, they may of course be flush with their support structure. This arrangement has greater effect than simple movement by deformation of a broad wall as in the prior art, because of the effect of the dielectric in the dark or less illuminated operating mode.

Figure 13A:
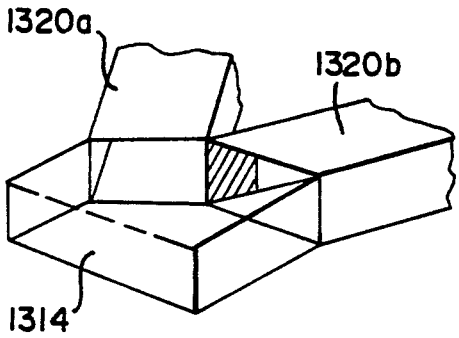
FIG. 13*a* is a partially phantom, perspective or isometric view of an H-plane junction according to the invention.
Figure 13B:
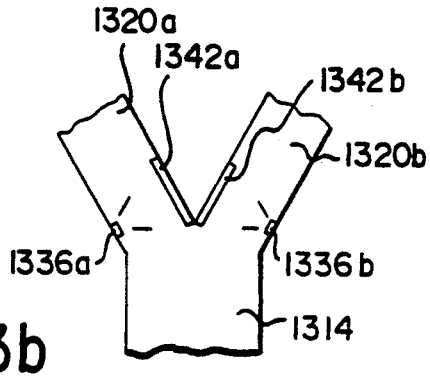
FIG. 13*b* is a corresponding plan view.

FIG. 13*a* is a conceptual view of an "H-plane" waveguide junction, in which an input waveguide 1314 joins two other waveguides 1320*a*, 1320*b* at a Wye. FIG. 13*b* is a conceptual plan view of the arrangement of FIG. 13*a*, illustrating the placement locations of photoconductive layers 1342*a* and 1342*b*, and of light sources 1336*a* and 1336*b*. Sources 1336*a* and *b* illuminate only their respective photoconductors 1342*a* and *b*, respectively. Power division between waveguides 1320*a* and 1320*b* depends upon their comparative cross-sectional areas, which as illustrated in FIG. 13 are equal. Light sources 1336*a* and 1336*b* are controlled inversely, so that one is at maximum illumination while the other is at minimum. This arrangement has the same effect as in an E-plane junction, in that the branch waveguide 1320*a* or 1320*b* in which the photoconductor is more intensely illuminated receives less power than the one less intensely illuminated.

Other embodiments of the invention will be apparent to those skilled in the art. For example, the conductive housings may be made from metal-plated plastics, and the exposed surfaces may be plated, anodized, or otherwise treated to reduce corrosion or resistance. While the photoconductive material has been described as supported by a wall of the waveguide, in principle it only needs to be within the fields near the function, so a free-standing photoconductive structure would not need to be supported by a wall.

What is claimed is:

1. A controllable waveguide comprising:

first, second and third hollow waveguide tubes for guiding electromagnetic waves, each of said waveguide tubes being defined by peripheral, electrically conductive walls of rectangular cross-section, including a pair of mutually opposed broad walls spaced apart by a pair of mutually opposed narrow walls;

a junction of said first, second and third waveguide tubes, in which said narrow walls of said first, second and third waveguide tubes are coplanar, whereby said junction is an E-plane junction, and in which one of said broad walls of said first waveguide tube is connected to one of said broad walls of said second waveguide tube; said junction being configured so that power coupling from said first waveguide tube to said third waveguide tube depends upon the relative impedances of said second and third waveguides;

photosensitive means, said photosensitive means being electrically non-conductive and having a dielectric constant in the absence of light, and being electrically conductive in the presence of light, said photosensitive means being associated with at least said second waveguide tube at a location adjacent said junction, for intercepting at least portions of the field of said second waveguide tube; and controllable illumination means located to illuminate at least portions of said photosensitive means, said controllable illumination means, when energized, causing a preferential coupling of waves from said first waveguide tube in favor of said third waveguide tube and not said second waveguide tube, and when not energized, reducing said preferential coupling.

2. A branch according to claim 1, wherein said photosensitive means is associated with that one wall of said broad walls of said second waveguide tube which is connected to a broad wall of said first waveguide tube.

3. A branch according to claim 2, wherein said illumination means comprises light generating means located in the other one of said broad walls of said second waveguide tube, opposed to said one wall with which said photosensitive means is associated.

4. A branch according to claim 3, wherein said light generating means comprises a semiconductor light generating device.

5. A branch according to claim 4, wherein said semiconductor light generating device comprises a transparent, light-emitting aperture which is electrically conductive in a direction generally transverse to the direction of propagation of said light.

6. A branch according to claim 5, wherein said electrically conductive aperture is generally flush with said other one of said broad walls of said second waveguide within which it is mounted.

7. A controllable branch according to claim 1, further comprising:

second, third, fourth, fifth and sixth transmission-line branches, each associated with junctions of fourth, fifth and sixth transmission lines:

coupling means for coupling (a) said third transmission line to said fourth transmission line of said second branch, (b) said sixth transmission line of said second branch to said fourth transmission line of said third branch, (c) said fourth transmission line of said fifth branch to said sixth transmission line of said fourth branch, (d) said fourth transmission line of said sixth branch to said sixth transmission line of said fifth branch, (e) said fifth transmission line of said fourth branch to said second transmission line, and (f) said fifth transmission lines of said fifth and sixth branches to said fifth transmission lines of said second and third branches, respectively, whereby said first transmission line, said fourth transmission line of said fourth branch, and said sixth transmission lines of said third and sixth branches are available.

8. An antenna system, comprising:

first and second transmission lines;

a signal source;

a plurality of antennas coupled to said first and second transmission lines which when energized, produce an antenna beam pointed in a direction which depends upon the relative power applied to said first and second transmission lines;

feed means coupled to said plurality of antennas and to said signal source, said feed means comprising:

(a) a third transmission line coupled to said signal source for guiding electromagnetic waves;

(b) a junction of said first, second and third transmission lines, said junction being configured so that power coupling from said third transmission line to said first and second transmission lines depends upon the relative impedances of said first and second transmission lines;

(c) photosensitive means, said photosensitive means being electrically nonconductive and having a dielectric constant in the absence of light, and being electrically conductive in the presence of light, said photosensitive means being associated with at least said second transmission line at a location adjacent said junction, for intercepting at least portions of the field of said second transmission line;

(d) controllable illumination means located to illuminate at least portions of said photosensitive means, said controllable illumination means, when energized, illuminating said photosensitive means for causing said photosensitive means to become electrically conductive, reducing the impedance of said second transmission line relative to that of said first transmission line, thereby causing a preferential coupling of waves from said third transmission line in favor of said first transmission line and not said second transmission line, and when not energized at least reducing said preferential coupling; and illumination control means coupled to said controllable illumination means for controlling said preferential coupling for controlling said relative power for thereby controlling said beam direction.

9. A controllable waveguide branch, comprising:

first, second and third waveguides for guiding electromagnetic waves;

a first E-plane junction of said first, second and third waveguides, said junction being configured so that power coupling from said first waveguide to said second and third waveguides depends upon the relative impedances of said first and second waveguides;

second, third, fourth, fifth and sixth waveguide E-plane branches, each associated with junctions of fourth, fifth and sixth waveguides;

coupling means for coupling (a) said third waveguide to said fourth waveguide of said second branch, (b) said sixth waveguide of said second branch to said fourth waveguide of said third branch, (c) said fourth waveguide of said fifth branch to said sixth waveguide of said fourth branch, (d) said fourth waveguide of said sixth branch to said sixth waveguide of said fifth branch, (e) said fifth waveguide of said fourth branch to said second waveguide, and (f) said fifth waveguides of said fifth and sixth branches to said fifth waveguides of said second and third branches, respectively, whereby said first waveguide, said fourth waveguide of said fourth branch, and said sixth waveguides of said third and sixth branches are available;

photosensitive means, said photosensitive means being electrically nonconductive and having a dielectric constant in the absence of light, and being electrically conductive in the presence of light, said photosensitive means being associated with at least said second waveguide at a location adjacent said first junction, for intercepting at least portions of the field of said second waveguide; and controllable illumination means located to illuminate at least portions of said photosensitive means, said controllable illumination means, when energized, causing a preferential coupling of waves from said first waveguide in favor of said third waveguide and not said second, and when not energized, reducing said preferential coupling.

* * * * *